United States Patent [19]

Bly

[11] 4,322,036

[45] Mar. 30, 1982

[54] DEVICE FOR DISPENSING AND DISPERSING LIQUID ADDITIVES IN SHOWER BATH WATER

[76] Inventor: Herbert A. Bly, 10 Shadowstone La., Lawrenceville, N.J. 08648

[21] Appl. No.: 120,979

[22] Filed: Feb. 13, 1980

[51] Int. Cl.[3] ..... B05B 7/30

[52] U.S. Cl. ..... 239/311

[58] Field of Search ..... 239/310, 311, 318, 428.5; 222/630

[56] References Cited

U.S. PATENT DOCUMENTS

| | | | |
|---|---|---|---|
| 2,316,781 | 4/1943 | Fox | 239/310 |
| 2,562,415 | 7/1951 | Chase | 239/310 X |
| 2,743,913 | 5/1956 | Gondlach | 239/311 |
| 3,231,200 | 1/1966 | Heald | 239/310 X |

*Primary Examiner*—Robert B. Reeves
*Assistant Examiner*—Gene A. Church

[57] ABSTRACT

A device for installation in the water supply pipe to a bath shower head comprising a venturi aspirator connected to a vented measuring chamber, said chamber connected to a supply container for liquid additive. Restricting the vent to the measuring chamber creates a pressure differential causing additive liquid to flow into said chamber. With the vent reopened, the liquid additive flows by gravity and differential pressure into the duct connected to the venturi aspirator, mixing the air and water flowing to the shower head and producing an aerated shower spray with liquid additive dispersed therein.

5 Claims, 1 Drawing Figure

DEVICE FOR DISPENSING AND DISPERSING LIQUID ADDITIVES IN SHOWER BATH WATER

SUMMARY OF THE INVENTION

A device for installation in the water supply pipe to a bath shower head comprising a venturi constriction in the supply pipe to the shower head, an aspiration duct connected to the high velocity section of the venturi, said duct connected to the upper and lower portions of a measuring chamber, a container for liquid additive connected to said measuring chamber, and a vent to atmosphere which may be temporarily restricted causing liquid to flow by differential pressure into the measuring chamber. When the vent to atmosphere is reopened, the measured quantity of liquid flows by gravity and differential pressure mixing with and dispersing in the air flowing into the duct connected to the aspirator orifice in the water supply pipe to the shower head. The addition of the aerated additive to the water upstream of the shower head increases the velocity of the dispersed water droplets flowing from the shower head and produces a more forceful and efficient washing action than the same volume of non-aerated water.

The object of the invention is to provide a means of adding a measured quantity of liquid, such as bath oil, skin care preparations, shampoo, liquid soap, or hair conditioner to shower bath water at a uniform rate with efficient and uniform dispersion. A secondary objective is to aerate the water to increase exit velocity from the shower head and provide substantially the same washing action as without use of the device while reducing the actual volume of water and energy consumed per unit time.

DRAWINGS

FIG. 1 is a cross-sectional view of the device showing the principal components and the inter-connecting ducts.

DETAILED DESCRIPTION

Figure 1:
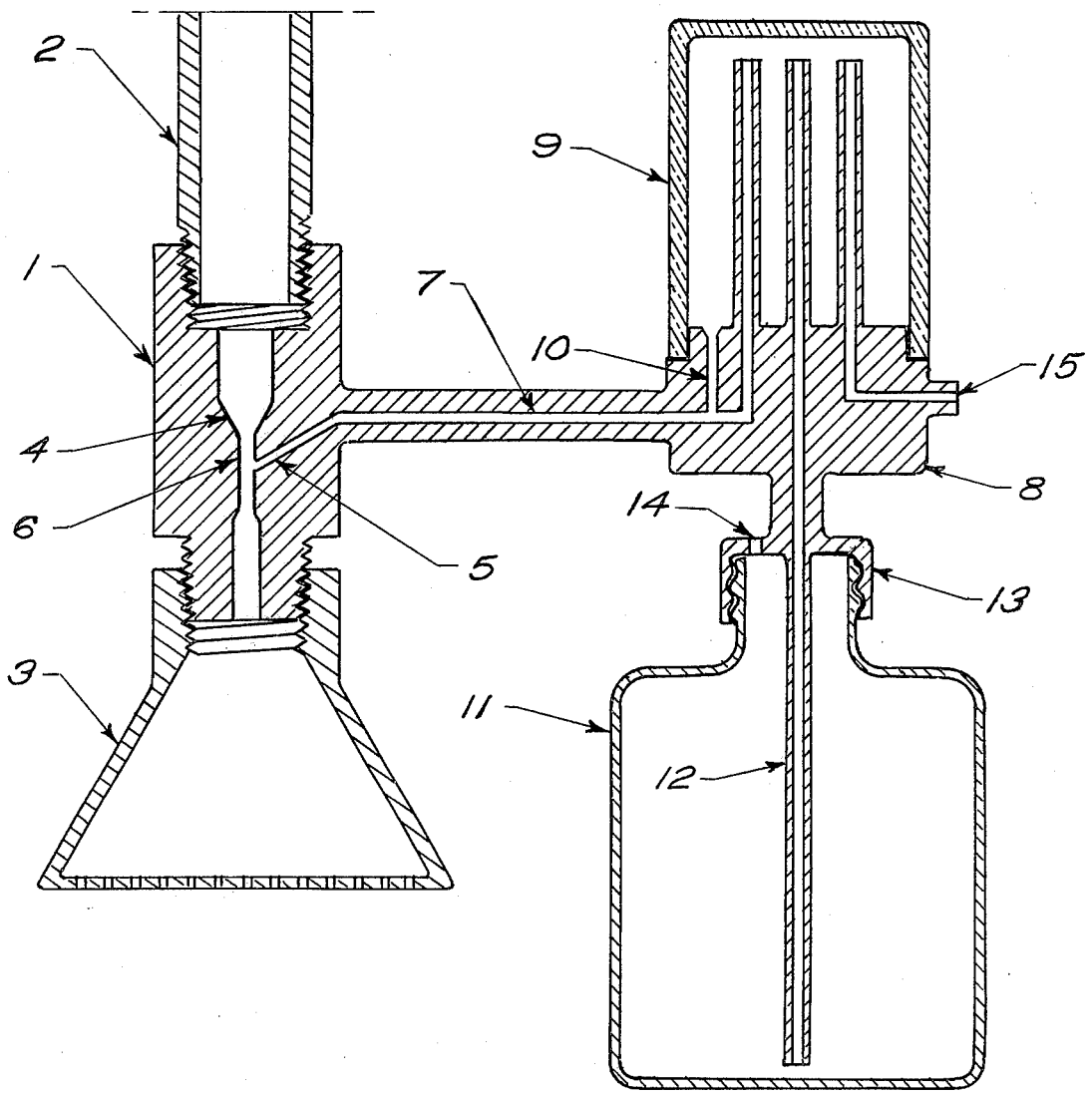

The continuous shower bath has become a common form of bathing throughout much of the modern world. The principal object of this invention is to overcome a disadvantage of the conventional shower bath by providing a means of dispensing and dispersing measured quantities of one or more additives in the water supplied to the shower head. The bather can thus efficiently apply bath oil, skin care and conditioning preparations, hair conditioning preparations, or other liquid material. It is also possible to dispense liquid soap or detergent, shampoo, and bubble bath preparations which emerge as a thick foam and provide a pleasant and practical means of washing hair and bathing.

A further object of this invention is to provide for induction and dispersion of air in the water at a volume ratio ranging from one to four parts of air per ten parts of water, which disperses the water droplets and causes an increase in exit velocity of the water from the shower head. This increased velocity combined with the tendency of aerated water to cling to surfaces by capillary attraction provides washing action equal to a greater quantity of non-aerated water, thus reducing consumption of bath water and energy.

Referring now to FIG. 1, showing the device in cross sectional form, the adapter coupling 1 is installed between the water supply pipe 2 and the conventional shower head 3. Said adapter coupling incorporates a venturi 4 with an aspiration duct 5 connected to the high-velocity restricted section of the venturi 6. The restriction is sized so that, in accordance with the well-known venturi principle, the absolute pressure of the water flowing in the high velocity section is lower than atmospheric pressure, thus creating an aspiration effect which will draw air or liquid or a combination of air and liquid into the main supply of water to the shower head. The aspiration duct 5 is connected by a duct 7 to the base 8 of a measuring chamber 9 the upper portion of which is formed of glass or transparent plastic graduated in volume units. Duct 7 is extended through base 8 to the upper portion of measuring chamber 9. A liquid metering duct 10 provides a connection from the bottom of measuring chamber 9 to duct 7.

A container 11 for additive liquid is suspended below base 8 and is connected through base 8 to the upper portion of the measuring chamber 9 by means of tube 12 which extends to the bottom of container 11. Base 8 also serves to support container 11 by means of an integral cap 13. Cap 13 is provided with a vent 14 open to atmosphere.

An air duct 15 passes through base 8 and extends to the upper portion of measuring chamber 9. In use, with water flowing normally to the shower head and when liquid additive is not being dispensed, the absolute pressure in venturi 6 is lower than atmospheric pressure, causing air to flow through air duct 15 into measuring chamber 9 and thence into duct 7 through which it flows into the aspiration duct 5 and disperses in the water flowing through venturi 6 to the shower head. This provides several additional benefits in addition to the principal object of the invention, that of dispensing liquid in the shower water. Since the volume of water flowing to the venturi is constant, the air entering in a volume ratio ranging from one to three parts of air per ten parts of water increases the volume of dispersed air/water mixture flowing through the shower head and thereby increases the velocity of the dispersed water droplets. The aerated water flowing at increased velocity provides a washing action as effective and pleasant as a larger volume of non-aerated water. Aerated water also has a tendency to cling to and flow over surfaces due to capillary attraction, further enhancing its washing action. A further benefit of aeration is therefore reduction in the quantity of water required as well as the energy consumed in heating and supplying it.

When it is desired to dispense and disperse a liquid additive, the user places his finger tip over the end of air duct 15, preventing entry of air. This immediately reduces the absolute pressure in measuring chamber 9 causing liquid additive to flow by differential pressure from container 11 through tube 10 into measuring chamber 9. Air vent 14 in cap 13 of container 11 allows entry of air to maintain full atmospheric pressure in container 11. When the desired quantity of liquid additive has entered measuring chamber 9, the user removes his finger from the end of air duct 15, stopping the flow of liquid, reestablishing the flow of air and allowing the liquid in the measuring chamber 9 to flow gradually by gravity and differential pressure through metering duct 10 into duct 7 where it disperses in the air flowing into venturi 6 and thence into the water flowing to the shower head.

It should be noted that it would be possible and practical to provide a separate second venturi in adapter coupling 1 combined with a separate second dispensing system identical to the one described to provide for the convenient addition of two different liquid additives to the shower water.

I claim:

1. A device for dispensing, aerating and dispersing liquid additives in a shower bath water system of the type including a water supply pipe and a bath shower head, said device comprising:

a coupling located between said water supply pipe and said bath shower head, said coupling including a venturi restriction therein through which water from said water supply pipe passes, said coupling further including an aspirating duct connected to said venturi restriction;

a premeasuring chamber means for premeasuring a determinable volume of liquid additive for dispensing, said premeasuring chamber means including an upper portion and a lower portion connected by a first duct and a second duct respectively to said aspirating duct;

a vented container for holding said liquid additive;

a tube extending from the inside of said container to the upper portion of said premeasuring chamber means; and, drawing means for selectively drawing a determinable volume of liquid additive from said container through said tube into said premeasuring chamber means, whereby manipulation of said drawing means draws liquid additive from said container through said tube into said premeasuring chamber means in an amount that may be controlled by said drawing means and measured in said premeasuring chamber means.

2. The device of claim 1 wherein said drawing means comprises a third duct communicating the upper portion of said premeasuring chamber means with external air, whereby closing off said third duct by finger pressure causes liquid additive from said container to be drawn up into said premeasuring chamber means.

3. The device of claim 2 wherein said second duct comprises a metering duct.

4. The device of claim 3 wherein said premeasuring chamber means includes a transparent cap portion thereon, said premeasuring chamber means also including calibrations therein to measure the volume of liquid additive drawn from said container.

5. The device of claim 4 wherein said premeasuring chamber means is located above said container.

* * * * *